US010709223B1

(12) United States Patent
Kim et al.

(10) Patent No.: US 10,709,223 B1
(45) Date of Patent: Jul. 14, 2020

(54) COSMETIC CONTAINER

(71) Applicant: YONWOO CO., LTD., Incheon (KR)

(72) Inventors: Sung Sin Kim, Incheon (KR); Young Moo Bae, Incheon (KR); Seo Hui Jung, Incheon (KR); Hyo Sun Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 16/670,285

(22) Filed: Oct. 31, 2019

(30) Foreign Application Priority Data

Apr. 2, 2019 (KR) ..... 10-2019-0038567

(51) Int. Cl.

| | |
|---|---|
| ***A45D 33/00*** | (2006.01) |
| ***A45D 33/02*** | (2006.01) |
| ***A45D 34/00*** | (2006.01) |
| ***B05B 11/00*** | (2006.01) |
| *A45D 40/00* | (2006.01) |

(52) U.S. Cl.
CPC ..... *A45D 33/025* (2013.01); *A45D 33/003* (2013.01); *A45D 34/00* (2013.01); *B05B 11/3001* (2013.01); *B05B 11/3095* (2013.01); *A45D 40/0075* (2013.01)

(58) Field of Classification Search
CPC .... A45D 33/025; A45D 33/003; A45D 34/00; A45D 40/0075; B05B 11/3095; B05B 11/3001
See application file for complete search history.

(56) References Cited

U.S. PATENT DOCUMENTS

| | | | | |
|---|---|---|---|---|
| 9,609,936 | B2 * | 4/2017 | Kim | A45D 40/00 |
| 9,788,633 | B2 * | 10/2017 | Jung | A45D 34/04 |
| 10,010,153 | B2 * | 7/2018 | Kim | A45D 33/06 |
| 10,399,763 | B2 * | 9/2019 | Kang | B65D 83/005 |
| 2016/0015149 | A1 * | 1/2016 | Kim | A45D 40/22 222/383.1 |
| 2017/0056905 | A1 * | 3/2017 | Lee | B05B 11/3001 |
| 2017/0305642 | A1 | 10/2017 | Kang | |

(Continued)

FOREIGN PATENT DOCUMENTS

| | | | | |
|---|---|---|---|---|
| KR | 20-0389166 | Y1 | 7/2005 | |
| KR | 10-2015-0096604 | A | 8/2015 | |
| KR | 2000014 | B1 * | 7/2019 | A45D 33/025 |

*Primary Examiner* — Frederick C Nicolas
(74) *Attorney, Agent, or Firm* — Novick, Kim & Lee, PLLC; Sang Ho Lee

(57) ABSTRACT

Provided is a cosmetic container including: a storage container for storing a cosmetic content therein; a pump coupled to a top of the storage container and configured to move the cosmetic content stored in the storage container upward; a pressurizing plate coupled to a top of the pump and having a discharge hole to discharge the cosmetic content moved from the pump upward; and a distribution plate disposed on a top of the pressurizing plate and distributing the cosmetic content discharged from the discharge hole outward, wherein the distribution plate includes at least one incised piece incisedly defined from an edge toward a central area thereof, each of the at least one incised piece disposed spaced apart from each other along the edge, and wherein distribution paths are defined by spaces apart from each other, the spaces disposed around the respective incised piece, and the distribution paths distribute the cosmetic content through the spaces.

8 Claims, 7 Drawing Sheets

(56) References Cited

U.S. PATENT DOCUMENTS

| | | | | |
|---|---|---|---|---|
| 2018/0116371 | A1 | 5/2018 | Kim et al. | |
| 2018/0207658 | A1* | 7/2018 | Lee | A45D 40/00 |
| 2019/0191847 | A1* | 6/2019 | Kang | A45D 33/025 |

* cited by examiner

COSMETIC CONTAINER

CROSS REFERENCE TO RELATED APPLICATION OF THE INVENTION

The present application claims the benefit of Korean Patent Application No. 10-2019-0038567 filed in the Korean Intellectual Property Office on Apr. 2, 2019, the entire contents of which are incorporated herein by reference.

BACKGROUND OF THE INVENTION

Field of the Invention

The present invention relates to a cosmetic container, particularly, a cosmetic container that is capable of uniformly discharging a cosmetic content therefrom.

Background of the Related Art

Generally, a solid cosmetic material like foundation or a liquid cosmetic material like sun block cream which is widely used, serves to protect a user's skin, to brighten the user's skin tone, and to improve his or her wrinkles. At this time, the cosmetic material is applied onto the user's skin through a puff.

In this case, the puff has to come into direct contact with the cosmetic material, and by this way a larger amount of cosmetic material may be applied to the puff than it is required according to a pressurizing force of the puff against the cosmetic material, thereby the cosmetic material can be unnecessarily consumed. To solve such problems, recently, there is provided a cosmetic container in which a cosmetic material is impregnated into a sponge, and if the sponge is pressurized against the puff, the liquid cosmetic material impregnated in the sponge is discharged and supplied to the puff.

However, the conventional cosmetic container has the same problems as mentioned above. In detail, a larger amount of cosmetic material than it is required may be applied to the puff according to a pressurizing force of the sponge against the cosmetic material, and further, if the sponge is pressurized with an excessive pressure caused by the user's mistake, the cosmetic material may be applied to the surface of puff coming into direct contact with the user's skin as well as the surface of puff close to the user's fingers, thereby causing the user inconvenience. Furthermore, the cosmetic material repeatedly comes into contact with the puff, thereby causing the puff to be contaminated.

So as to solve such problems, recently, a compact cosmetic container has been developed to discharge a cosmetic material filled in a container body through a user's pressurization against a pump. Generally, the compact cosmetic container has a cosmetic dish on which a plurality of discharge holes is formed at the center thereof, and if a puff is contactedly pressurized against the cosmetic dish, the cosmetic material is discharged by the pump and is thus applied to the surface of the puff.

Even in case of the compact cosmetic container, however, the cosmetic material is discharged collectively from an area where the discharge holes are formed, and accordingly, it is hard to uniformly apply the cosmetic container to the entire surface of the pump.

Therefore, there is a need to develop a new cosmetic container capable of solving the above-mentioned problems.

SUMMARY OF THE INVENTION

Accordingly, the present invention has been made in view of the above-mentioned problems occurring in the prior art, and it is an object of the present invention to provide a cosmetic container that is capable of uniformly discharging a cosmetic content therefrom by a distribution plate having a plurality of incised pieces.

To accomplish the above-mentioned object, according to the present invention, there is provided a cosmetic container including: a storage container for storing a cosmetic content therein; a pump coupled to a top of the storage container and configured to move the cosmetic content stored in the storage container upward; a pressurizing plate coupled to a top of the pump and having a discharge hole to discharge the cosmetic content moved from the pump upward; and a distribution plate disposed on a top of the pressurizing plate and distributing the cosmetic content discharged from the discharge hole outward, wherein the distribution plate includes at least one incised piece incisedly defined from an edge toward a central area thereof, each of the at least one incised piece disposed spaced apart from each other along the edge, and wherein distribution paths are defined by spaces apart from each other, the spaces disposed around the respective incised piece, and the distribution paths distribute the cosmetic content thorough the spaces.

According to the present invention, the central area of the distribution plate is spaced apart from the pressurizing plate and the discharge hole on an upward direction, and at least a portion of the central area is convex upward, wherein the central area is configured to be pressurized by a user and to be moved downward and to come into contact with the top of the pressurizing plate.

According to the present invention, each of the incised piece becomes narrower in width toward the central area from the edge of the distribution plate and the distribution paths are radially arranged.

According to the present invention, one end of each the incised piece is connected with the edge of the distribution plate, and the other end thereof is separated from the central area of the distribution plate.

According to the present invention, when the pressurizing force of the user is not applied to the distribution plate, the other end of each of the incised piece is located lower than other areas of the distribution plate.

According to the present invention, the spaces defining the distribution paths become gradually narrower in widths from the central area to the edge of the distribution plate.

According to the present invention, the cosmetic container further includes a fixing cap pressurizing the edge of the distribution plate and fixing the distribution plate to the pressurizing plate.

According to the present invention, the cosmetic container further includes a snap on cap coupled to the top of the storage container to surround a top end periphery of the fixing cap and adapted to prevent the fixing cap from being moved when the distribution plate is pressurized by the user.

According to the present invention, the fixing cap has at least one locking protrusion disposed on the outer peripheral surface thereof, and the snap on cap has a limitation edge periphery protruding inward from the upper inner peripheral surface thereof, and an upward movement of the locking protrusion is limited by the limitation edge periphery preventing the fixing cap from vibrating.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
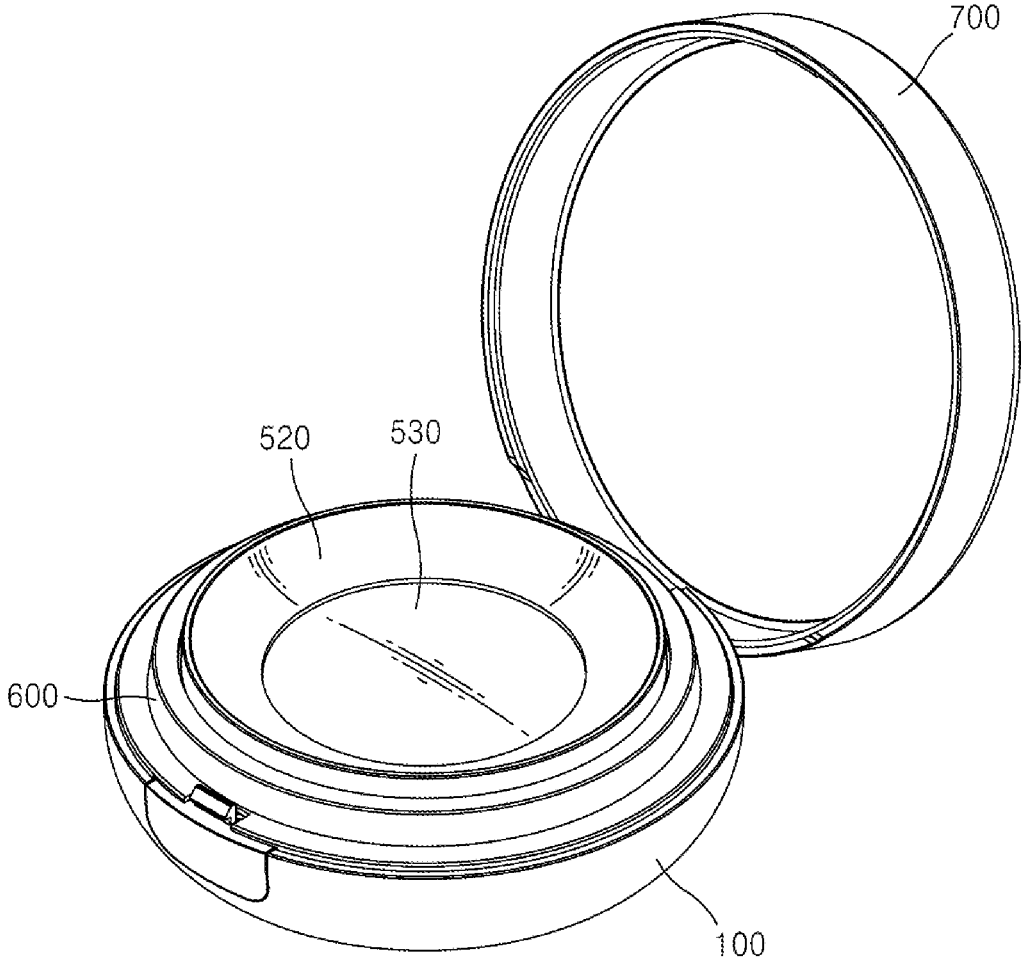
FIG. 1 is a perspective view showing a cosmetic container according to the present invention.

Hereinafter, the present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well-known technology related to the present invention makes the scope of the present invention not clear, the explanation will be avoided for the brevity of the description. Also, an embodiment of the present invention as will be discussed later will be in detail described so that it may be carried out easily by those having ordinary skill in the art, and therefore, this does not limit the idea and technical scope of the invention. In the description, every direction as will be described later may be determined with respect to the drawings, and therefore, they should be not necessarily defined on the basis of the whole scope of the present invention.

When it is said that one element is described as being "connected" or "coupled" to the other element, one element may be directly connected or coupled to the other element, but it should be understood that another element may be present between the two elements. In the description, when it is said that one portion is described as "includes" any component, one element further may include other components unless no specific description is suggested. Terms, such as the first, the second, A, B, (a), and (b) may be used to describe various elements, but the elements should not be restricted by the terms. The terms are used to only distinguish one element from the other element.

Figure 2:
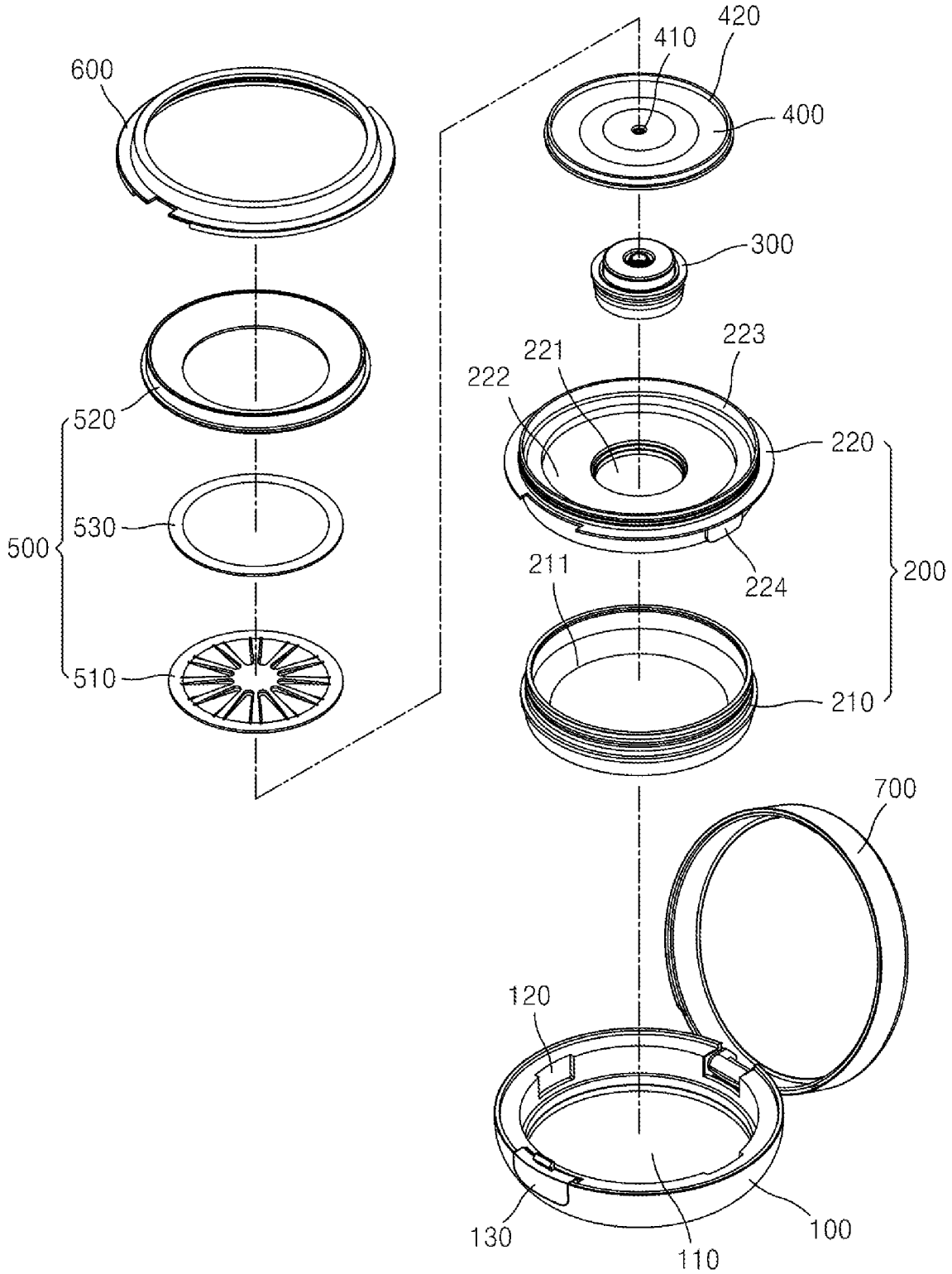
FIG. 2 is an exploded perspective view showing the cosmetic container according to the present invention.
Figure 3:
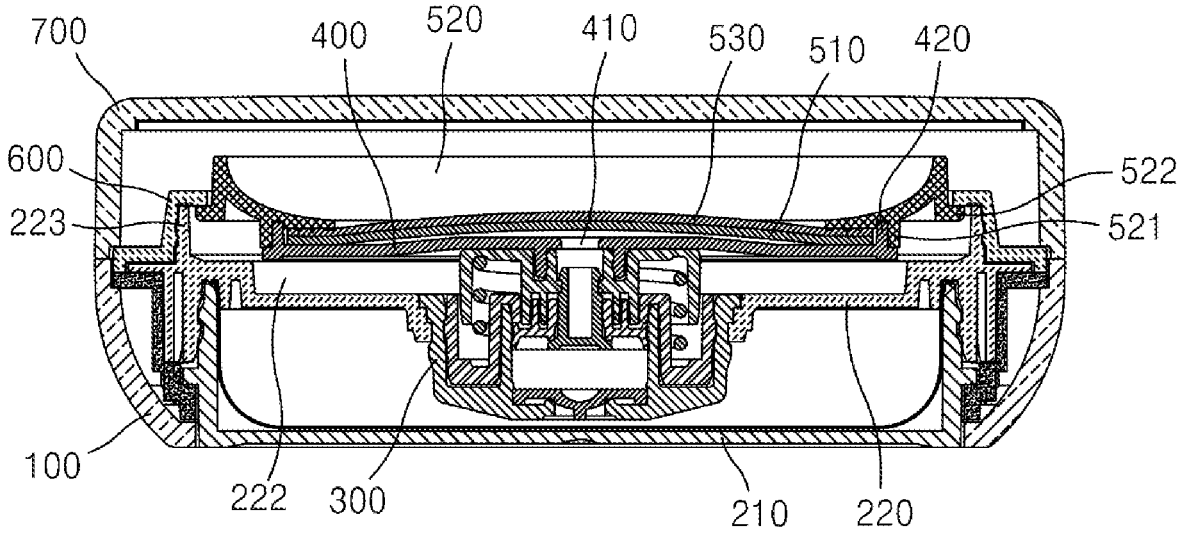
FIG. 3 is a sectional view showing the cosmetic container according to the present invention.
Figure 4:
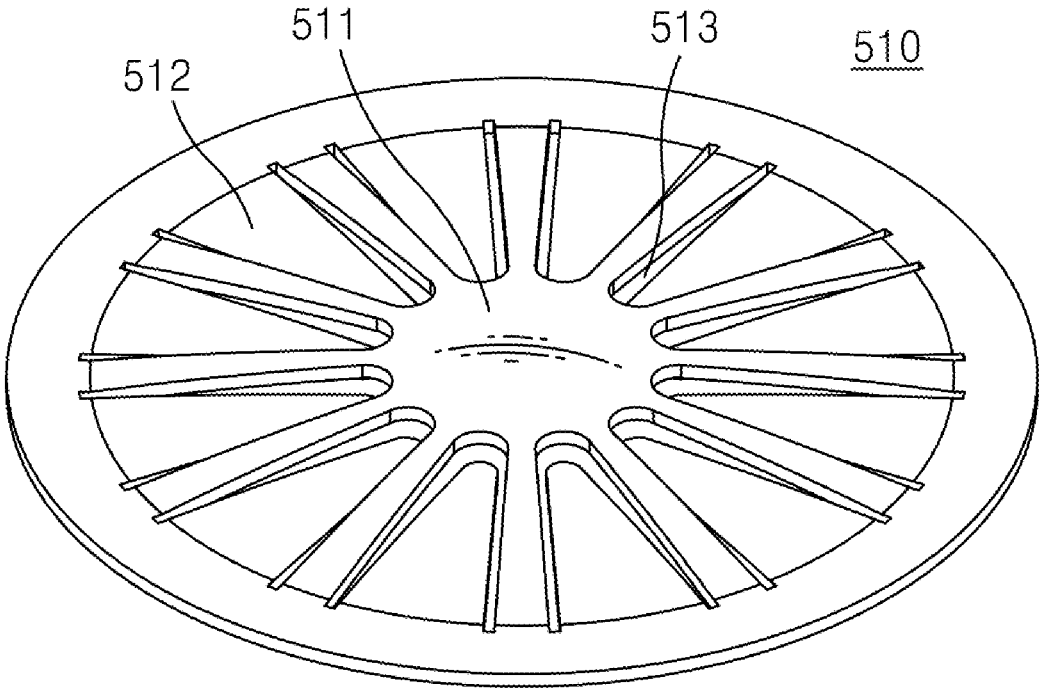
FIG. 4 is a perspective view showing a distribution plate of the cosmetic container according to the present invention.
Figure 5A:
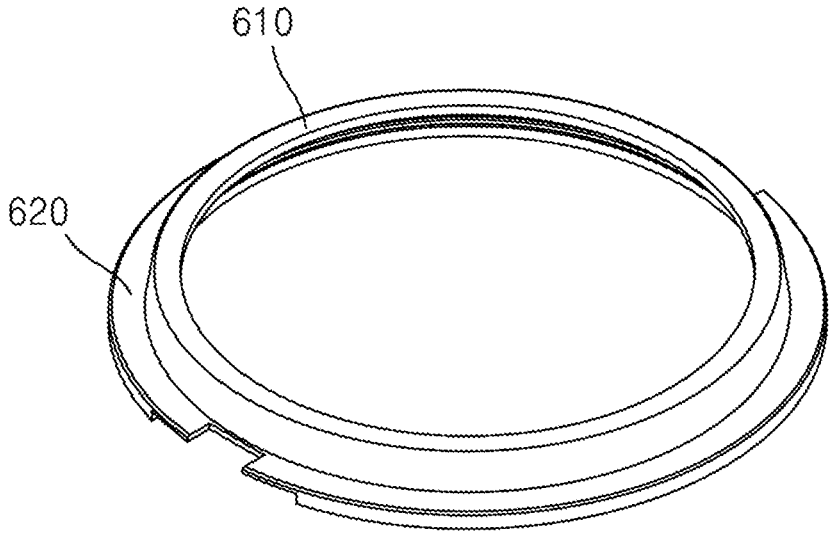
FIGS. 5A and 5B are perspective views showing a snap on cap of the cosmetic container according to the present invention.
Figure 5B:
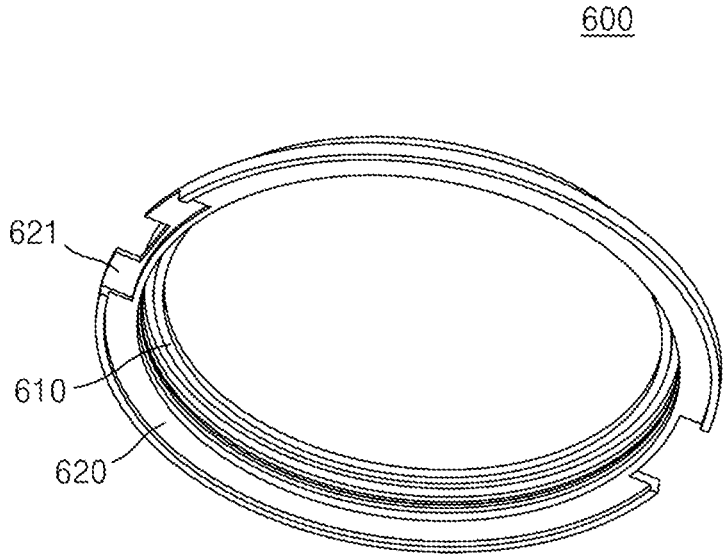

FIG. 1 is a perspective view showing a cosmetic container according to the present invention, FIG. 2 is an exploded perspective view showing the cosmetic container according to the present invention, FIG. 3 is a sectional view showing the cosmetic container according to the present invention, FIG. 4 is a perspective view showing a distribution plate of the cosmetic container according to the present invention, and FIGS. 5A and 5B are perspective views showing a snap on cap of the cosmetic container according to the present invention.

As shown in FIGS. 1 to 5B, the cosmetic container according to the present invention includes a container body 100, a storage container 200, a pump 300, a pressurizing plate 400, a distributor 500, a snap on cap 600, and an outer cap 700.

The container body 100 is open on top thereof and has a first accommodation portion 110 formed at the inside thereof to accommodate the storage container 200. For example, the first accommodation portion 110 has a shape corresponding to an outer shape of the storage container 200 (particularly, a lower container 210). Also, the container body 100 has coupling grooves 120 concavedly formed on the inner peripheral surface of the first accommodation portion 110 to a shape corresponding to coupling protrusions 224 formed on the outer peripheral surface of the storage container 200, so that the container body 100 is coupled to the storage container 200. However, the coupling method is just one example, and the container body 100 and the storage container 200 may be coupled to each other by means of various coupling methods, without being limited thereto.

The container body 100 has a button 130 disposed on one side thereof to open and close the outer cap 700. For example, a fastening protrusion (having no reference numeral) protrudes from top of the button 130, and a fastening groove is formed on one side of the inner peripheral surface of the outer cap 700, so that through the coupling between the fastening protrusion and the fastening groove, the outer cap 700 seal the container body 100, and if the button 130 is pressurized by a user, the fastening protrusion is separated from the fastening groove to allow the container body 100 to be opened.

According to the present invention, the container body 100 further has an open portion (having no reference numeral) formed on the underside thereof. For example, at least a portion of the underside of the container body 100 is penetrated into the inner periphery of the first accommodation portion 110 to form the open portion, and through the open portion, at least a portion of the underside of the storage container 200 accommodated into the first accommodation portion 110 is exposed to the outside of the container body 100. Accordingly, the outwardly exposed portion of the storage container 200 is pressurized by the user, thereby allowing the storage container 200 to be easily separated from the container body 100.

The storage container 200 is detachably coupled to the first accommodation portion 110 and stores a cosmetic content. In this case, the cosmetic content is a cosmetic fluid (that is, a cosmetic material). For example, the cosmetic content includes a cosmetic material like a liquid type foundation for make-up and a cosmetic material like gel type sun block cream for skin care, but it may include all types of fluid cosmetic materials, without being limited thereto.

The storage container 200 includes the lower container 210 and an upper container 220.

The lower container 210 has a second accommodation portion 211 formed at the inside thereof to accommodate the cosmetic content therein. The lower container 210 has a coupling protrusion or screw thread formed along the upper outer periphery thereof in such a manner as to be coupled to the upper container 220.

The upper container 220 is coupled to an upper periphery of the lower container 210 to seal the second accommodation portion 211 in which the cosmetic content is stored. The upper container 220 has a coupling hole 221 formed at the center thereof in such a manner as to be coupled to the pump 300. For example, a coupling protrusion and a stepped projection (having no reference numeral) are formed on the inner peripheral surface of the coupling hole 221 and on the outer peripheral surface of the pump 300 in such a manner as to correspond to each other, so that the lower periphery of the pump 300 is press-fitted onto the coupling hole 221.

The upper container 220 has a concave groove 222 formed around the coupling hole 221 on the top thereof. As the concave groove 222 is pressurized by the user, it serves as a space for moving the pressurizing plate 400 and the distributer 500 downward. Further, the upper container 220 has a first coupling edge periphery 223 protruding upward from the top periphery thereof. Through the first coupling edge periphery 223, the snap on cap 600 can be detachably coupled to the top periphery of the storage container 200.

The pump 300 is coupled to the top of the storage container 200 and sucks the cosmetic content stored in the storage container 200 through changes in an internal pressure thereof to move the sucked cosmetic content to a discharge hole 410 of the pressurizing plate 400. The changes in the internal pressure of the pump 300 are caused by the pressurization of the user applied to the distributer 500 and the pressurizing plate 400. For example, the pump 300 includes a cylinder, a piston, a sealing member, a stem, a shaft, an elastic member, and a pump housing, but it may have various components as well known in this art, without being limited thereto.

The pressurizing plate 400 is coupled to the top of the pump 300 and transfers an external force caused by the pressurization of the user to the pump 300. For example, if the distributor 500 is pressurized by a cosmetic tool like a puff, the external force generated from the pressurization is transferred to the pump 300 through the pressurizing plate 400, so that the pump 300 performs a pumping operation. The pressuring plate 400 has the discharge hole 410 formed on a given area thereof in such a manner as to communicate with the pump 300. For example, the discharge hole 410 is penetrated into the center of the pressurizing plate 400 to discharge the cosmetic content moved through the pump 300 upward (that is, toward a distribution plate 510 as will be discussed later).

The pressurizing plate 400 has a second coupling edge periphery 420 protruding upward from the top periphery thereof. The second coupling edge periphery 420 is coupled to a fixing cap 520 for fixing the distribution plate 510 to prevent the cosmetic content discharged through the discharge hole 410 from leaking to the outside of the pressurizing plate 400.

The distributor 500 is configured to uniformly distribute the cosmetic content and has the distribution plate 510 and the fixing cap 520.

The distribution plate 510 is disposed on top of the pressurizing plate 400 to distribute the cosmetic content discharged from the discharge hole 410 outward (that is, toward an edge periphery thereof). To do this, the distribution plate 510 has a central area 511 and at least one or more incised pieces 512 arranged to surround the central area 511.

The central area 511 is aligned with the discharge hole 410 and is spaced upward apart from the pressurizing plate 400 and the discharge hole 410. To do this, at least a portion of the distribution plate 510 is bent convexedly upward therefrom. If the central area 511 is pressurized by the user, it is moved downward through the elastic deformation of the distribution plate 510 and comes into contact with the top of the pressurizing plate 400. As a result, the central area 511 of the distribution plate 510 serves to push the cosmetic content discharged from the discharge hole 410 outward (that is, toward an edge periphery thereof). On the other hand, if the pressurizing force generated from the user is released, the central area 511 of the distribution plate 510 is returned to its original convex shape by means of the elastic restoring force thereof. Like this, the central area 511 of the distribution plate 510 has the convex shape so that it is spaced upward apart from the pressurizing plate 400 and is elastically deformed upward and downward in response to the pressurizing force of the user to discharge the cosmetic content and the release of the pressurizing force, thereby making the user feel as if a cushion is pressed at the time when the central area 511 is pressurized.

The incised pieces 512 are incisedly formed from the edge periphery of the distribution plate 510 toward the central area 511 in such a manner as to be spaced apart from each other to surround the central area 511 of the distribution plate 510. The formation of the incised pieces 512 allows the distribution paths 513 to be formed on the distribution plate 510 to distribute the cosmetic content in the outward direction. In detail, spaces between the respective incised pieces 512 serve as the distribution paths 513 for distributing the cosmetic content.

According to the present invention, the incised pieces 512 become narrow in width as they go toward the central area 511 from the edge periphery of the distribution plate 510. Accordingly, the distribution paths 513, which are formed on the distribution plate 510 by the incised pieces 512, are radially arranged.

According to the present invention, further, one end of each incised piece 512 is connected unitarily with the edge periphery of the distribution plate 510, and the other end thereof is separated from the central area 511 of the distribution plate 510. As a result, the central area 511 and the incised pieces 512 of the distribution plate 510 are elastically deformed, independent of each other, and otherwise, they may be movable upward or downward. In detail, for example, even if the central area 511 of the distribution plate 510 is pressurized or released from the pressurization, the incised pieces 512 are elastically deformed unitarily with the central area 511, and otherwise, they may not be moved downward or upward.

According to the present invention, furthermore, if the pressurizing force of the user is not applied to the other end of each incised piece 512 separated from the central area 511 of the distribution plate 510, the other end of the incised piece 512 is located lower than other areas (especially, the central area 511) of the distribution plate 510. For example, an inclined angle of the incised piece 512 is formed differently from the other areas, so that the other end of the incised piece 512 can be located lower than other areas. Accordingly, the spaces (that is, the distribution paths 513) formed along the edges of the incised pieces 512 have the greatest widths on one end toward the central area 511, and their widths become gradually narrower toward the edge periphery of the distribution plate 510.

The fixing cap 520 is configured to pressurize the distribution plate 510 to fix the distribution plate 510 to the top of the pressurizing plate 400. In detail, the fixing cap 520 pressurizes the edge periphery of the distribution plate 510 in a state where the distribution plate 510 is disposed on the top of the pressurizing plate 400 and thus couples the distribution plate 510 to the pressurizing plate 400, so that the edge periphery of the distribution plate 510 can be fixedly brought into close contact with the top of the pressurizing plate 400. To do this, the fixing cap 520 has a third coupling edge periphery 521 protruding downward from the underside thereof in such a manner as to be fastened to the second coupling edge periphery 420. For example, the second coupling edge periphery 420 is inserted into the third coupling edge periphery 521 and is thus press-fitted thereonto, thereby coupling the fixing cap 520 to the pressurizing plate 400. To perform such coupling, a coupling protrusion and/or a coupling groove are formed correspondingly on the outer periphery of the second coupling edge periphery 420 and/or the inner periphery of the third coupling edge periphery 521.

The fixing cap 520 has a round limitation projection (having no reference numeral) protruding upward therefrom to prevent the cosmetic content discharged from the distribution plate 510 from flowing outward. According to the present invention, the inner peripheral surface of the limitation projection is a downward inclined or curved surface toward the distribution plate 510.

The fixing cap 520 has at least one locking protrusion 522 formed on the outer peripheral surface thereof to prevent movements. As shown, the locking protrusion 522 is a round edge periphery formed along the outer peripheral surface of the fixing cap 520.

On the other hand, the pressurizing plate 400, the distribution plate 510, and the fixing cap 520 are physically separated from each other, but according to the present invention, some or all of them may be formed integrally with each other.

The distributor 500 further has a mesh screen 530 disposed on top of the distribution plate 510. The mesh screen 530 is a flexible screen having a plurality of fine punched holes and is formed of a single screen or multiple screens. The mesh screen 530 is made of polyethylene (PE) or contains it, but it may be made of other materials or contain them, without being limited thereto. The mesh screen 530 is disposed on top of the distribution plate 510 to prevent the cosmetic content discharged from springing up from the distribution plate 510, and at the time when the distribution plate 510 is pressurized by a cosmetic tool like a puff to apply the cosmetic content to the cosmetic tool, the mesh screen 530 serves to allow an appropriate amount of cosmetic content to be applied to the cosmetic tool.

The snap on cap 600 is coupled to top of the storage container 200 to surround the top end periphery of the fixing cap 520. For example, a coupling protrusion and/or a coupling groove are formed correspondingly on the outer periphery of the first coupling edge periphery 223 of the storage container 200 and/or the inner periphery of the snap on cap 600, so that the snap on cap 600 can be detachably press-fitted onto the first coupling edge periphery 223.

The snap on cap 600 serves to prevent the distributor 500 from being moved. To do this, the snap on cap 600 has a limitation edge periphery 610 protruding inward from the upper inner peripheral surface thereof. The locking protrusion 522 formed on the outer peripheral surface of the fixing cap 520 is disposed under the limitation edge periphery 610, thereby limiting an upward movement of the fixing cap 520. Accordingly, if the distribution plate 510 is pressurized by the user, the distributor 500 inclusive of the fixing cap 520 can be prevented from being moved asymmetrically.

The snap on cap 600 has a seating portion 620 formed on the lower outer periphery thereof. For example, the seating portion 620 protrudes outward from the lower outer peripheral surface of the snap on cap 600, and at the time when the snap on cap 600 and the storage container 200 are coupled to each other, the underside of the seating portion 620 is brought into close contact with the top of the storage container 200. According to the present invention, the snap on cap 600 has an accommodation groove 621 formed on the underside of the seating portion 620 to accommodate the top of the button 130 of the container body 100. Further, a given area of the accommodation groove 621 is penetrated to allow the fastening protrusion of the button 130 to be exposed upward therefrom.

The outer cap 700 serves to seal the container body 100. The outer cap 700 is connected to the container body 100 by a connector like a hinge formed on one side thereof. The connector serves to prevent the outer cap 700 from being separated from the container body 100 at the time when the outer cap 700 is placed at an open position. According to the present invention, the outer cap 700 may be coupled directly to the container body 100, without any connector. For example, the outer cap 700 and the container body 100 have screw threads formed on the inner peripheral surfaces thereof so that they are coupled to each other through rotation.

The cosmetic container further includes a housing for accommodating the cosmetic tool like a puff. According to the present invention, the housing is disposed on top of the distribution plate 510 and/or the mesh screen 530. According to the present invention, further, the housing is configured to allow the cosmetic tool to be separated from the distribution plate 510 and/or the mesh screen 530, without any contact. According to the present invention, furthermore, the housing is connected to a portion of the cosmetic container in such a manner as to be movable by means of a hinge.

On the other hand, the coupling methods of the parts as mentioned above are just exemplary, and accordingly, various coupling methods may be adopted according to embodiments of the present invention. For example, if a protrusion and a groove are press-fitted onto each other, positions or shapes of the protrusion and the groove may be changed, and instead of the press-fitting, otherwise, screw coupling may be adopted.

Figure 6A:
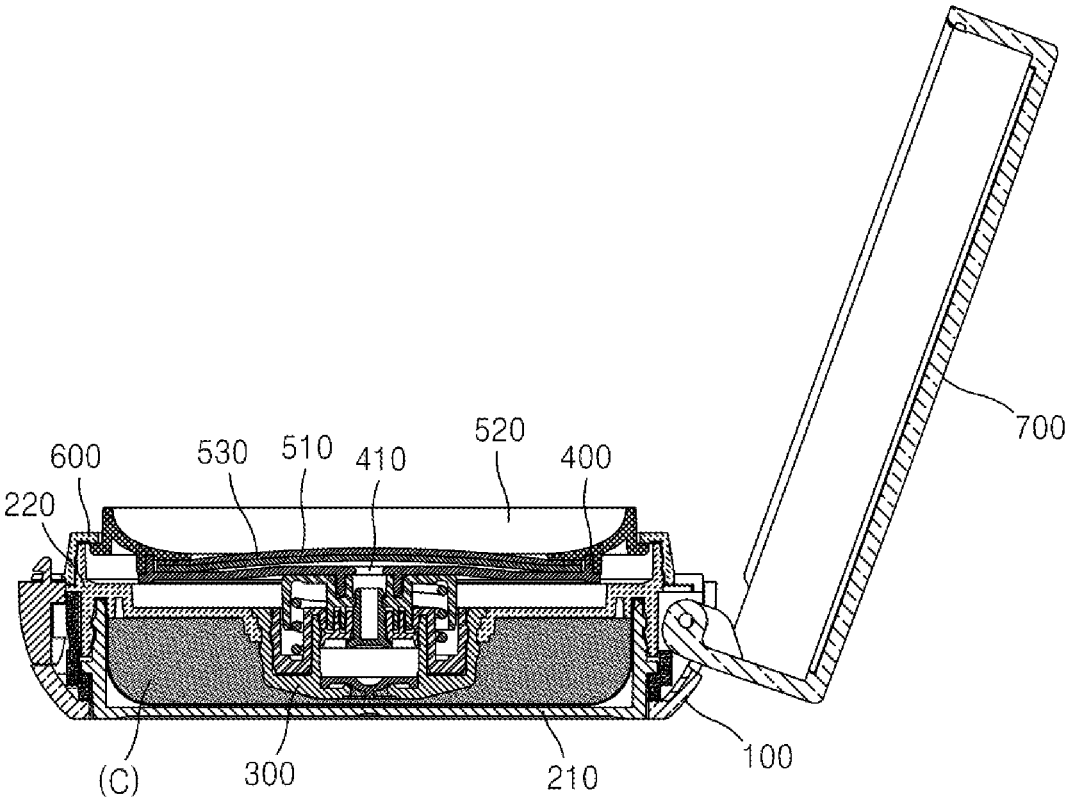
FIGS. 6A and 6B are sectional views showing exemplary operations of the cosmetic container according to the present invention.
Figure 6B:
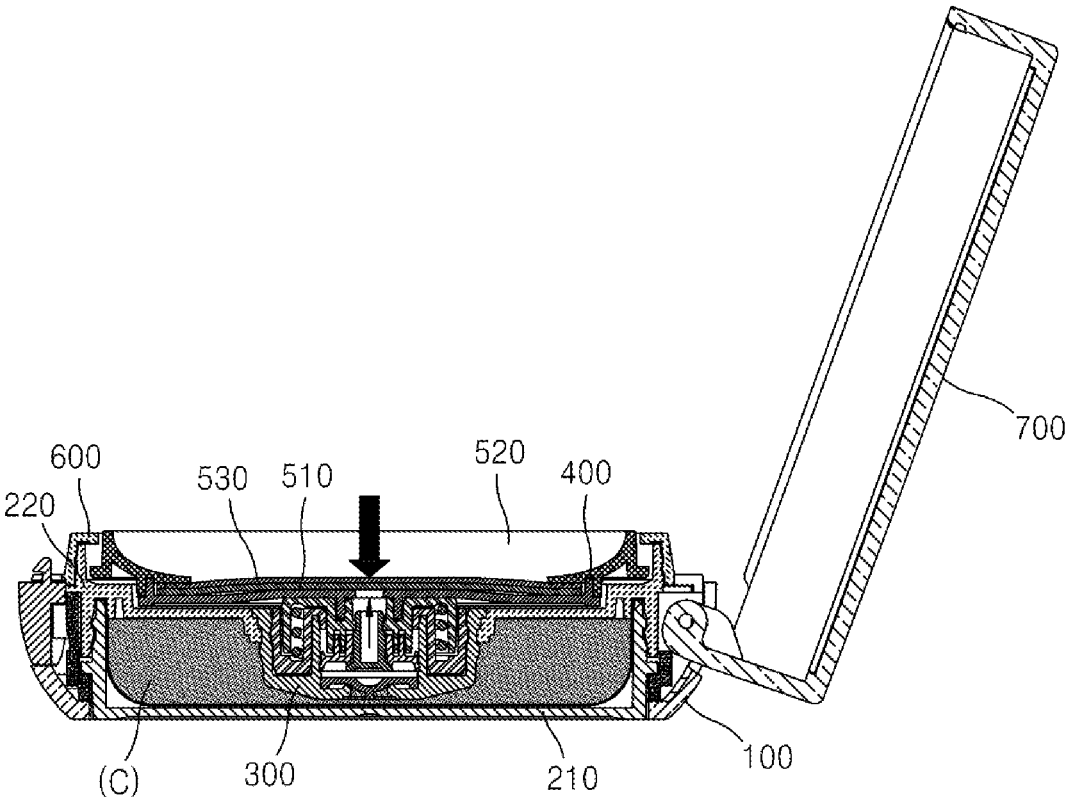

FIGS. 6A and 6B are sectional views showing exemplary operations of the cosmetic container according to the present invention.

As shown in FIG. 6A, the distribution plate 510 is convex upward before the distributor 500 is pressurized, and especially, the central area 511 of the distribution plate 510 is spaced apart from the pressurizing plate 400 and the discharge hole 410. At this time, the incised pieces 512 formed on the distribution plate 510 are located lower than other areas of the distribution plate 510, so that the spaces (that is, the distribution paths 513) are sufficiently formed along the incised pieces 512.

After that, as shown in FIG. 6B, if the distribution plate 510 and the mesh screen 530 are pressurized by the user, the pump 300 is operated to discharge the cosmetic content upward toward the distribution plate 510. For example, if the distribution plate 510 and the mesh screen 530 are pressurized by the cosmetic tool like a puff by the user, the distributor 500 and the pressurizing plate 400 are moved down, together, so that the interior of the pump 300 is compressed to discharge the cosmetic content toward the central area 511 of the distribution plate 510 through the discharge hole 410 of the pressurizing plate 400.

At this time, the central area 511 of the distribution plate 510 is moved down until it comes into contact with the top of the pressurizing plate 400, so that it pushes the cosmetic content discharged from the discharge hole 410 toward the incised pieces 512 arranged along the edge periphery of the distribution plate 510. Accordingly, the cosmetic content is uniformly distributed to the outer periphery (edge periphery) through the distribution paths 513 formed along the incised pieces 512. On the other hand, the cosmetic content distributed uniformly through the distribution plate 510 is applied to the entire surface of the cosmetic tool through the mesh screen 530.

After that, if the pressurizing force of the user is released, the pressurizing plate 400 and the distributor 500 are returned to their original position, and the central area 511 of the distribution plate 510 is moved up by its elastic force and is thus spaced apart from the pressurizing plate 400 and the discharge hole 410.

Like this, the pressurization of the user against the distribution plate 510 and the release of the pressurization are repeatedly carried out, thereby discharging an amount of the cosmetic content required, and particularly, as the distribution plate 510 is elastically deformed during the discharging process of the cosmetic content, thereby making the user feel as if a cushion is pressed.

As described above, the cosmetic container according to the present invention can effectively distribute the cosmetic content through the distribution plate, so that as the cosmetic tool is pressurized against the distribution plate, the cosmetic content can be applied uniformly to the entire surface of the cosmetic tool.

In addition, the cosmetic container according to the present invention is configured to allow the central area of the distribution plate to be convex in such a manner as to be spaced upward from the pressurizing plate, so that the distribution plate is elastically deformed according to the pressurization and release of the user, thereby making the user feel as if a cushion is pressed.

Further, the cosmetic container according to the present invention is configured to simplify the structure of the distribution plate, thereby lowering a processing cost, an error occurrence probability, and a defective occurrence probability.

Furthermore, the cosmetic container according to the present invention is configured to couple the snap on cap to the cosmetic container, thereby effectively preventing the distribution plate and the fixing cap from being moved at the time when the cosmetic content is discharged.

The present invention may be modified in various ways and may have several exemplary embodiments. Terms used in this application are used to only describe specific exemplary embodiments and are not intended to restrict the present invention. Accordingly, it should be understood that the invention covers all the modifications, equivalents, and replacements within the idea and technical scope of the invention. Therefore, the present invention is not to be restricted by the embodiment but only by the appended claims.

What is claimed is:

1. A cosmetic container comprising:

a storage container for storing a cosmetic content therein;

a pump coupled to a top of the storage container and configured to move the cosmetic content stored in the storage container upward;

a pressurizing plate coupled to a top of the pump and having a discharge hole to discharge the cosmetic content moved from the pump upward; and a distribution plate disposed on a top of the pressurizing plate and distributing the cosmetic content discharged from the discharge hole outward, wherein the distribution plate comprises at least one incised piece incisedly defined from an edge toward a central area thereof, each of at least one incised piece disposed spaced apart from each other along the edge, and wherein distribution paths are defined by spaces disposed apart from each other and around the each of the at least one incised piece, and the distribution paths distribute the cosmetic content through the spaces, wherein the central area of the distribution plate is spaced apart from the pressurizing plate and the discharge hole in an upward direction, and at least a portion of the central area is convex upward, wherein the central area is configured to be pressurized by a user and to be moved downward and to come into contact with the top of the pressurizing plate.

2. The cosmetic container of claim 1, wherein each of the incised piece becomes narrower in width toward the central area from the edge of the distribution plate and the distribution paths are radially arranged.

3. The cosmetic container of claim 1, wherein one end of each the incised piece is connected with the edge of the distribution plate, and an other end thereof is separated from the central area of the distribution plate.

4. The cosmetic container of claim 3, wherein when pressurizing force of the user is not applied to the distribution plate, the other end of each of the incised piece is located lower than other areas of the distribution plate.

5. The cosmetic container of claim 4, wherein the spaces defining the distribution paths become gradually narrower in widths from the central area to the edge of the distribution plate.

6. The cosmetic container of claim 1, further comprising a fixing cap pressurizing the edge of the distribution plate and fixing the distribution plate to the pressurizing plate.

7. The cosmetic container of claim 6, further comprising a snap on cap coupled to the top of the storage container to surround a top end periphery of the fixing cap and adapted to prevent the fixing cap from being moved when the distribution plate is pressurized by the user.

8. The cosmetic container of claim 7, wherein the fixing cap has at least one locking protrusion disposed on outer peripheral surface thereof, and the snap on cap has a limitation edge periphery protruding inward from upper inner peripheral surface thereof, and an upward movement of the locking protrusion is limited by the limitation edge periphery preventing the fixing cap from vibrating.

* * * * *